United States Patent [19]

Hirschey

[11] 4,045,188

[45] Aug. 30, 1977

[54] FUEL ADDITIVES FOR INTERNAL COMBUSTION ENGINES

[76] Inventor: Kenneth A. Hirschey, 6804 Southdale Road, Edina, Minn. 55435

[21] Appl. No.: 644,626

[22] Filed: Dec. 29, 1975

[51] Int. Cl.[2] ..... C10L 1/02

[52] U.S. Cl. ..... 44/56; 44/77

[58] Field of Search ..... 44/56, 77, 57

[56] References Cited

U.S. PATENT DOCUMENTS

| | | | |
|---|---|---|---|
| 1,690,988 | 11/1928 | Marley et al. | 44/56 |
| 2,078,736 | 4/1937 | Schurink | 44/56 |
| 2,087,582 | 7/1937 | Schneider | 44/56 |
| 2,093,008 | 9/1937 | Egerton | 44/77 |
| 2,219,859 | 10/1940 | White | 44/56 |
| 2,891,851 | 6/1959 | Bailey et al. | 44/77 |

*Primary Examiner*—Daniel E. Wyman
*Assistant Examiner*—Mrs. Y. Harris-Smith
*Attorney, Agent, or Firm*—Orrin M. Haugen

[57] ABSTRACT

An additive for hydrocarbon motor fuels for internal combustion engines which consists of ditertiarybutyl peroxide contained in a solvent medium. The solvent medium is preferably ditertiarybutyl alcohol along with a lower melting solvent, such as isopropyl alcohol, benzene, or mixtures thereof. The organic peroxide is normally present in the fuel in an amount ranging from between about 0.1 ppm. to about 1 ppm., with best results being obtained within that range.

3 Claims, No Drawings

FUEL ADDITIVES FOR INTERNAL COMBUSTION ENGINES

BACKGROUND OF THE INVENTION

The present invention relates generally to an improved fuel for internal combustion engines, and particularly improved gasoline for gasoline burning internal combustion engines. The fuel is conventional gasoline to which the additive has been added, the additive having been found to improve engine performance and economy, thereby obtaining an increase in fuel economy. Either conventional fuels containing tetraethyl lead nor non-leaded gasoline may be improved with this material.

In the past, it has been observed that the addition of certain peroxides, including organic peroxides improves characteristics of engine fuels, particularly diesel fuel. Reference is made to U. S. Pats. Nos. 2,655,440 and 2,763,536. Traditionally, the guantities present are substantial and may vary from about 0.001 percent up to about 30 percent of peroxide.

The present invention includes the recognition that an additive containing small quantities of an organic peroxide specifically ditertiarybutyl peroxide along with a stabilizing solvent medium in exceptionally samll concentrations provides a marked increase in fuel economy measured in miles per gallon, without sacrificing other performance characteristics of the fuel. The stabilizing solvent medium preferably contains ditertiarybutyl alcohol, with the presence of this substance being believed to enhance the overall stability of the formulation, particularly in a working solution of gasoline, and further provides reasonable mixing performance along with the best overall reproducible performance results.

SUMMARY OF THE INVENTION

Briefly, in accordance with the present invention, an improved hydrocarbon motor fuel for gasoline burning internal combustion engines has been developed, for use with traditional or conventional leaded or unleaded gasolines, the gasoline containing ditertiarybutyl peroxide in a solvent. The solvent is preferably ditertiarybutyl alcohol for purposes of stability, along with either isopropyl alcohol, benzene, or mixtures thereof, to depress the solid point, with the solvent medium also preferably containing isopropyl alcohol. The small concentrations required to achieve effective performance range from between about 0.1 ppm. to about 1 ppm. for the organic peroxide, with the solvent medium normally being contained in a range from between about 100ppm. and 250 ppm.

Therefore, it is a primary object of the present invention to provide an improved hydrocarbon motor fuel for gasoline burning internal combustion engines which contains an additive in small quantities, the additive consisting of ditertiarybutyl peroxide, and the solvent medium preferably containing ditertiarybutyl alcohol along with either isopropyl alcohol, benzene, or mixtures thereof.

It is a further object of the present invention to provide an improved hydrocarbon motor fuel for gasoline burning internal combustion engines which contains an additive in small quantities, the additive consisting of a mixture of ditertiarybutyl peroxide contained in a solvent medium of ditertiarybutyl alcohol as a stabilizer and eitherisopropyl alcohol, or mixtures of isopropyl alcohol and benzene as a solid point depressant.

It is yet a further object of the present invention to provide an improved hydrocarbon motor fuel for gasoline burning internal combustion engines wherein the fuel contains an additive which improves engine economy without adversely affecting engine performance, the additive consisting of an organic peroxide, specifically ditertiarybutyl peroxide in a solvent medium, the solvent being ditertiarybutyl alcohol as a stabilizer and either isopropyl alcohol or a mixture of isopropyl alcohol and benzene as a solid point depressant.

Other and further objects of the present invention will become apparent to those skilled in the art upon a study of the following specification and appended claims.

PREFERRED DESCRIPTION OF THE EMBODIMENT

In order to best disclose the various aspects of the present invention, the following examples are given:

EXAMPLE 1

A mixture of 10 percent ditertiarybutyl peroxide and 90 percent ditertiarybutyl alcohol was prepared. This mixture was then mixed with a solvent comprising 2 parts of isopropyl alcohol to 1 part of benzene, with the ditertiarybutyl peroxide-ditertiarybutyl alcohol mixture then being added to the solvent in a ratio of 1 part of the ditertiarybutyl peroxide-ditertiarybutyl alcohol mixture to 24 parts of the isopropyl alcohol-benzene solvent.- This formulation was then mixed with gasoline in amounts equivalent to from 0.1 ppm. up to about 1 ppm., and the mileage performance of the gasoline was increased by an amount equivalent to the following:

| Quantity of Peroxide Present in ppm. | Engine Performance, Miles per gallon |
|---|---|
| 0 | 18.26 |
| 0.14 | 18.60 |
| 0.27 | 18.60 |
| 0.35 | 18.4 |
| 0.43 | 18.3 |
| 0.54 | 19.04 |
| 1.04 | 18.6 |
| 1.35 | 18.5 |

The gasoline utilized was commercially available, having been obtained from Standard Oil Company of Indiana as "regular" grade fuel containing tetraethyl lead. Also, it should be noted that when ditertiarybutyl peroxide was added in quantities significantly greater than the 1.35 ppm., mileage performance continued to fall, and ultimately fell belowthe original range of 18.26 miles per gallon.

EXAMPLE 2

The additive mixture was described in Example 1 was added to a standard unleaded fuel with mileage increases of up to about 10 percent being obtained, the peak improvement being observed when ditertiarybutyl peroxide was present in the fuel in an amount ranging from between about 0.5 ppm. to about 0.9 ppm. The performance fell below that obtained without ditertiarybutyl peroxide when this material was present in an amount greater than about 2.5 ppm. The fuel utilized was a regular grade fuel containing tetraethyl lead available from Standard Oil Company of Indiana.

EXAMPLE 3

The additive mixture as described in Example 1 was added in various quantities to a regular grade of gasoline containing tetraethyl lead with the following results:

| Quantity of Peroxide Present in ppm. | Engine Performance, Miles per gallon |
|---|---|
| 0 | 19.95 |
| 0.1 | 20.20 |
| 0.21 | 20.94 |
| 0.45 | 20.20 |
| 1.00 | 19.95 |

The fuel used was that obtained from a commercial source, known as "Super America" brand regular gasoline.

EXAMPLE 4

The mixture of ditertiarybutyl peroxide and ditertiarybutyl alcohol from Example 1 was mixed with a modified solvent medium. The solvent medium consisted of isopropyl alcohol alone, and substantially the same improved performance was found to result.

EXAMPLE 5

The ditertiarybutyl peroxide-ditertiarybutyl alcohol mixture was formulated with a solvent medium consisting of isopropyl alcohol, with the ratio of components being 29 parts of iospropyl alcohol to 1 part of ditertiarybutyl peroxide-ditertiarybutyl alcohol mixture. This material, as formulated, was added to a conventional leaded gasoline in an amount equivalent to about 1 part per million with improved performance.

EXAMPLE 6

The formulation of Example 5 was repeated, except that the solvent medium contained 4 parts of isopropyl alcohol to 1 part of benzene, with improved engine performance resulting from this mixture being added to gasoline in a ratio of 0.5 ppm.

GENERAL DISCUSSION

It has been determined that ditertiarybutyl alcohol and ditertiarybutyl peroxide may be mixed on a basis of 50:50 in a mixture up to approximately 90:10, ditertiarybutyl alcohol to ditertiarybutyl peroxide. The ratio of approximately 90:10 is normally perferred inasmuch as this has been found to provide the most consistent performance, and also provides a mixture which is stable for storage purposes, both before and after formulating with the fuel. For convenience in handling, since this material has a solidification point of approximately 60° F., it is generally mixed with a solvent for the purpose of depressing the solid point, with the solvent normally being isopropyl alcohol, benzene, or mixtures thereof.

For certain purposes, the ditertiarybutyl peroxide-ditertiarybutyl alcohol materials may be initially diluted with gasoline fuel, and thereafter added directly to a storage facility or a transporting facility. For convenience in adding, the additive is formulated with peroxide present in such an amount that approximately 1 part of the additive to about 8,000 to about 10,000 parts of fuel will be involved.

It will be appreciated that the presence of ditertiarybutyl alcohol tends to enhance the overall performance observed. In this connection, however, for purposes of handling of the additive, normally up to about 20 parts of ditertiarybutyl alcohol may be accommodated for each part of ditertiarybutyl peroxide. Increases in the ditertiarybutyl alcohol content beyond this range do not appear to have any significant improving effect.

While the theoretical basis for the improvement in performance is not known precisely, it is believed that the presence of the organic peroxide reduces the quantity of unburned hydrocarbons, with a resultant reduction in carbon monoxide as a product of combustion from the internal combustion engine. It has further been determined that the addition of the solvent medium without peroxides present have little, if any, affect on engine economy and performance. It is believed, therefore, that the combination of the ditertiarybutyl peroxide with ditertiarybutyl alcohol provides a synergistic effect in the performance of the internal combustion engine to a degree such that engine performance measured in miles per gallon can be increased from between about 6.6 percent up to about 28 percent. The improvement is more pronounced with leaded gasolines, that is, gasolines containing tetraethyl lead, than those which do not contain this traditional component. In this connection, the performance of engines fueled with leaded gasolines increased from between about 9 percent up to 28 percent, while those being fueled with unleaded gasoline increased from 6.6 percent up to 14 percent.

I claim:

1. Hydrocarbon motor fuel for internal combustion engines and containing an additive therein consisting of an admixture of ditertiarybutyl peroxide and ditertiarybutyl alcohol on a basis of between about 1 part peroxide to about 20 parts ditertiarybutyl alcohol up to about 1 part ditertiarybutyl peroxide to about 1 part of ditertiarybutyl alcohol, with the ditertiarybutyl peroxide - ditertiarybutyl alcohol admixture being present in said fuel in an amount ranging from between about 0.1 ppm. to about 1 ppm. of the ditertiarybutyl peroxide component.

2. The hydrocarbon motor fuel and additive as defined in claim 1 wherein said ditertiarybutyl peroxide-ditertiarybutyl alcohol admixture is present on a basis of approximately 1 part of ditertiarybutyl peroxide to 9 ditertiarybutyl alcohol.

3. The hydrocarbon motor fuel and additive as defined in claim 1 wherein a solvent is present in said ditertiarybutyl peroxide-ditertiarybutyl alcohol admixture, with said solvent being selected from the group consisting of isopropyl alcohol, benzene, and mixtures thereof.

* * * * *